US005585338A

United States Patent [19]

Beltzer

[11] Patent Number: 5,585,338

[45] Date of Patent: Dec. 17, 1996

[54] AVIATION TURBINE OILS OF IMPROVED LOAD CARRYING CAPACITY CONTAINING MERCAPTOBENZOIC ACID

[75] Inventor: Morton Beltzer, Westfield, N.J.

[73] Assignee: Exxon Research and Engineering Company, Florham Park, N.J.

[21] Appl. No.: 563,837

[22] Filed: Nov. 28, 1995

[51] Int. Cl.[6] ..... C10M 135/28

[52] U.S. Cl. ..... 508/518

[58] Field of Search ..... 252/48.6, 57

[56] References Cited

U.S. PATENT DOCUMENTS

| | | | |
|---|---|---|---|
| 2,216,751 | 10/1940 | Rosen | 252/48.6 |
| 2,368,605 | 1/1945 | White | 252/48.6 |
| 3,730,485 | 5/1973 | Strang et al. | 252/57 |
| 4,157,971 | 6/1979 | Yaffe et al. | 252/48.6 |
| 4,174,284 | 11/1979 | Borel et al. | 252/48.6 |
| 4,189,388 | 2/1980 | Yaffe et al. | 252/48.6 |
| 5,160,649 | 11/1992 | Cardis et al. | 252/48.6 |

*Primary Examiner*—Jacqueline V. Howard
*Attorney, Agent, or Firm*—Joseph J. Allocca

[57] ABSTRACT

An aviation turbo oil having improved load carrying ability (extreme pressure capacity) comprising a major portion of a base oil stock and a minor portion of a mercaptobenzoic acid or mixture of mercaptobenzoic acids.

9 Claims, No Drawings

AVIATION TURBINE OILS OF IMPROVED LOAD CARRYING CAPACITY CONTAINING MERCAPTOBENZOIC ACID

BACKGROUND OF THE INVENTION

1. Field of the Invention

This invention relates to aviation turbo oils having high load carrying capacity, said oil comprising a base oil and additives which impart the load carrying capacity.

2. Description of the Related Art

Lubricants must possess a high load carrying capacity in order to be able to transmit strong forces between mating metal surfaces, gears for example, while controlling (preventing or minimizing) metal damage and wear under heavily loaded conditions. Extreme Pressure (EP) additives present in the lubricant operate to reduce and minimize metal damage by preventing seizure and welding between metal surfaces working under extreme pressure conditions. Under such conditions (i.e., boundary lubrication) the ability of the lubricant to prevent wear is no longer dependent on the hydrodynamic (i.e., viscometric) properties of the lubricant but on its chemical (EP) properties.

EP additives function by reacting chemically with the metal surfaces producing a sacrificial layer of low shear strength thereby minimizing wear of metal surfaces and preventing welding (seizure) of the moving, interfacing metal parts.

EP additives usually consist of sulfur, phosphorus or chlorine containing compounds. These atoms are the reactive centers of the EP additives, and consequently can also be quite corrosive to the metals they are intended to protect.

EP additives must meet a difficult combination of requirements. It must possess high surface activity in order to attain complete surface coverage over the entire rubbing surfaces which are in contact. The EP additive must be sufficiently surface active to successfully compete for reactive surface sites of the metal with other components present in the oil (e.g., the base stock itself, corrosion inhibitor, etc.) yet at a sufficiently low concentration in order to minimize adverse interactions with the other components in the lubricating oil.

Extensive surface coverage however, is in itself an insufficient condition for an EP additive's activity. The additive should react with the metal surfaces only under high load conditions when high flash temperatures are attained in the contact region, that is when there is the abrupt transition from boundary lubrication conditions (which are satisfied by the antiwear properties of the oil) to EP conditions (which rely on the chemical interaction of the EP additive with the metal). The ideal EP additive will react with the metal surfaces under the extreme conditions of pressure and temperature of the mating surfaces and not before these conditions are attained. Premature reaction of the EP additive with the metal results in significant corrosion.

Widely used EP additives are sulfurized fatty oils, sulfur chloride treated fatty oils, chlorinated paraffin wax, chlorinated paraffin wax sulfides, aliphatic and aromatic disulfides such as dibenzyldisulfide, dibutyl disulfide, chlorobenzyl disulfide. Chlorine containing EP additives are not suitable for use in aviation turbine oils due to their corrosivity, as are most sulfur containing EP additives. EP additives for aviation turbine oils must also be ashless, so EP additives such as lead naphthenates are unsuitable.

Aviation turbo oils typically have employed anti wear/extreme pressure additives including hydrocarbyl phosphate esters, particularly trihydrocarbyl phosphate esters in which the hydrocarbyl radical is an aryl or alkaryl radical or mixture thereof. Particular anti wear/extreme pressure additives which have been used include tricresyl phosphate, triaryl phosphate and mixtures thereof.

Other extreme pressure additives include those having sulfhydril (e.g., mercapto groups) but in general they have been found to be corrosive to copper.

It would be beneficial if an additive could be identified which imparted load carrying capability to the oil at low treat rates and which was noncorrosive to copper and compatible with the other materials used in the engine and seals.

DESCRIPTION OF THE INVENTION

The present invention relates to an aviation turbo oil of improved load carrying capacity and reduced copper corrosivity comprising a base oil stock suitable for use as an aviation turbine oil stock and a minor portion of a mercaptobenzoic acid or mixture of mercaptobenzoic acids and to a method for lubricating an aviation turbo engine to withstand high loads and extreme pressures comprising operating the engine with a lubricating oil composition comprising a major portion of a base oil stock and a minor portion of a mercaptobenzoic acid or mixture of mercaptobenzoic acids.

In the lubricating oil composition of the present invention, the lubricating oil will contain a major amount of a lubricating oil base stock. The lubricating oil base stocks suitable for use as aviation turbine oil stocks are well known in the art and can be derived from natural lubricating oils, synthetic lubricating oils, or mixtures thereof. In general, the lubricating oil base stock will have a kinematic viscosity ranging from about 5 to about 10,000 cSt at 40° C., although typical applications will require an oil having a viscosity ranging from about 10 to about 1,000 cSt at 40° C.

Natural lubricating oils include petroleum oils, mineral oils, and oils derived from coal and shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc., as well as oils produced by the hydroisomerization of natural and synthetic waxes (ex slack waxes and Fischer-Tropsch waxes).

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

A particularly preferred aviation turbo oil base stock is polyol ester prepared by the esterification of an aliphatic polyol with carboxylic acid. Examples of polyols are trimethylolpropane, pentaerythritol, dipentaerythritol, neopentyl glycol, tripentaerythritol and mixtures thereof. The carboxylic acid reactant used to produce the polyol ester base oil is selected from aliphatic monocarboxylic acid or a mixture of aliphatic monocarboxylic acid and aliphatic dicarboxylic acids.

The monocarboxylic acids contain from 4 to 12 carbon atoms and include the straight and branched chain aliphatic acids, and mixtures of monocarboxylic acids may be used.

A preferred polyol ester base oil is one prepared from technical pentaerythritol and a mixture of $C_5$–$C_{10}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the formula

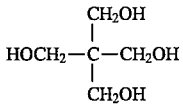

and about 12% dipentaerythritol of the formula

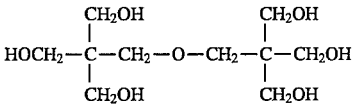

The technical pentaerythritol may also contain some tri and tetra pentaerythritol that is normally formed as byproducts during the manufacture of technical pentaerythritol.

The preparation of esters from alcohols and carboxylic acids can be accomplished using conventional methods and techniques known and familiar to those skilled in the art. In general, the aliphatic polyol is heated with the desired carboxylic acid or mixture of acids, optionally in the presence of a catalyst. Usually, a slight excess of acid is employed to force the reaction to completion. Water is removed during the reaction and any excess acid is then stripped from the reactive mixture. The esters of technical pentaerythritol may be used without further purification or may be further purified using conventional techniques such as distillation.

The base oil stock is combined with the mercapto-benzoic acid which is added in an amount in the range 0.05 to 1.00 wt %, preferably 0.10 to 0.50 wt %, most preferably 0.10 to 0.15 wt %.

The mercaptobenzoic acid used is of the general formula

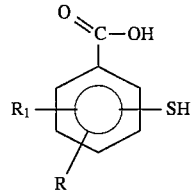

where the SH group is in the ortho position and R and $R_1$ may be the same or different and selected from H, $C_1$–$C_{10}$ hydrocarbyl group or if R is hydrocarby group, $R_1$ is hydrogen or hydrocarbyl. Preferably R and $R_1$ are H.

The aviation turbo oil may contain other performance enhancing additives such as corrosion inhibitors, hydrolytic stabilizers, pour point depressants, anti-foaming agents, viscosity and viscosity index improvers, antioxidants. The total amount of such other additives can be in the range 0.5 to 15 wt %, preferably 2 to 10 wt %, most preferably 3 to 8 wt %.

Lubricating oil additives are described generally in "Lubricants and Related Products" by Dieter Klamann, Verlag Chemie, Deerfield Florida, 1984 and also in "Lubricant Additives" by C. V. Smalheer and R. Kennedy Smith, 1967 pages 1–11, the disclosures of which are incorporated herein by reference.

The invention may be further understood by reference to the following examples and comparisons.

EXAMPLE 1

A test oil (Test Oil 1) comprising 0.024 wt % thiosalicylic acid (TSA) as EP additive in polyolester turbo oil base stock was prepared. This test oil also contained antiwear additives, antioxidants, hydrolytic stabilizers and copper corrosion inhibitors in a total amount of about 4.175 wt % (the balance comprising the base oil).

The commercial oil comprised a polyolester base stock, antiwear additive, antioxidant, copper corrosion inhibitor and lead corrosion inhibitor, the additives being used in an amount of about 5.22 wt %. These oils were evaluated and compared in the four ball initial seizure load test, the FZG test capability tests as well as for copper oxidation (copper oxidation corrosion stability test [OCS]).

These test procedures are described below:

Four Ball Initial Seizure Load Test

The initial seizure load is the load at which there is a rapid increase in wear as measured by a Four Ball Test. The Four Ball Tester used in this work is described in "Standard Handbook of Lubrication Engineering" Section 27, page 4, J. J. O'Connor, Editor in Chief, McGraw-Hill Book Company (1968). In this test, three balls are fixed in a lubricating cup and an upper rotating ball is pressed against the lower three balls. The test balls utilized were made of AISI 52100 steel with a hardness of 65 Rockwell C (840 Vickers) and a centerline roughness of 25 nm. Prior to the tests, the test cup, steel balls, and all holders were washed with 1,1,1 trichloroethane. The steel balls subsequently were washed with a laboratory detergent to remove any solvent residue, rinsed with water and dried under nitrogen. The test lubricant covers the stationary three balls.

The seizure load tests are performed at room temperature at 1500 RPM for a one minute duration at a given load. After each test, the balls are washed and the wear scar diameter (WSD) on the lower balls measured using an optical microscope. The load at which the wear scar equals or exceeds one millimeter is the initial seizure load (ISL).

The FZG Test is a measure of extreme pressure properties in accordance with DIN 51354. In this test, gear wheels are run in the lubricant under investigation in a dip lubrication system at a constant speed and a fixed initial oil temperature. The load on the tooth flanks is increased in stages from 1 to 12. The change in tooth flanks is recorded at the end of each load stage by description, roughness measurement, or contrast impressions. The effectiveness of the lubricant oil is determined by the load at which the sum total of the width of all the damaged areas exceeds one gear tooth width. This load stage is known as the failure load stage (FLS). The higher the (FLS), the more effective the lubricant oil tested.

The standard FZG conditions are 90° C. temperature at the start of the test and a pinion gear rotational speed of 2170 RPM. The FZG test employed in this and the following examples is more severe than the standard FZG test. The conditions employed are an initial oil temperature 140° C. and a pinion gear rotational speed of 3000 RPM.

Compatibility Tests (1) Shell 560 Compatibility—required for military approval 100 cc of test oil mixed with 100 cc of Shell 560 oil After standing for 168 hours at 105° C., the sample is filtered and the sediment weighed. If the sediment exceeds more than 2 mg/200 cc, the oil fails.

(2) Self Compatibility—measure of how much sediment the oil itself produces after standing by itself (unmixed with any other oils) for 168 hours at 105° C. Again, if the sediment exceeds more than 2 mg/200 cc, the oil fails.

The results are presented below:

| Tests | Test Results | | |
|---|---|---|---|
| | Test Oil 1 | Commercial Oil | Specification |
| 4-Ball ISL, Kg | 92.5 | 62.5 | — |
| Severe FZG (FLS) | 7 | 4.5 | — |
| OCS (400° F.) 72 hrs. | | | |
| Δ % Viscosity | 16.0 | 16.2 | ≦25 |
| Δ TAN (mg KOH/g) | 0.18 | 1.21 | ≦3 |
| Sludge (mg/100 cc) | 2.8 | 5.3 | ≦50 |
| Δ Cu (mg/sq cm) | −0.085 | −0.030 | ≦0.4 |
| Δ Ag (mg/sq cm) | −0.023 | −0.05 | ≦0.2 |
| Δ Mg, Al, Fe (mg/sq cm) | 0.008 | −0.02 | ≦0.2 |

The same oil was evaluated for compatibility with silicone seals as well as for compatibility with itself and with other turbo oils (which may be used). These results are presented below:

| Compatibility Silicone | Test Results | Specifications MIL-L-23699 D/E |
|---|---|---|
| % swell | 7.54 | 5–25 |
| % change tensile strength* | −13.89 | 0–30 |
| Shell 560 (mg/200 cc) | 1.24 | ≦2 |
| Self (mg/200 cc) | 0.32 | ≦2 |

*negative number indicates a decrease in tensile strength.

EXAMPLE 2

A number of other mercapto substituted or comparable oil additive materials were evaluated as EP load additives in the above described commercial oil or comparable oils at 0.10% loading. This was accomplished by reducing the basestock content to accommodate the 0.10% additional additive. These results are presented below (Table A). These results are to be compared to those obtained using thiosalicylic acid (2 mercapto benzoic acid) as the extreme pressure, load additive (also reported in Table A).

EXAMPLE 3

The corrosivity of turbo oils both with and without thiosalicylic acid extreme pressure-load additive for a number of other metals and alloys was evaluated on the Rolls Royce 1002A test (RR 1002A). In this test, the oils are maintained at 200° C. for eight days. The turbo oils are identified as Test Oil 2 and Test Oil 3.

Test Oil 2 is a polyolester based oil which contains an amine antioxidant, antiwear, corrosion inhibitor, hydrolytic stabilizer and lead corrosion inhibitor additive package present in a total amount of 6.316%, the balance being basestock.

Test Oil 3 is a polyolester based oil which contains the same additive package as Test Oil 2 in the same amount but additionally contains 0.094% thiosalicylic acid, the balance being basestock.

Test Oil 4 is Test Oil 2 (but modified).

The result of these tests are presented in Table B.

The effect of turbo oils with thiosalicylic acid additive present at two different concentrations on silicone seals is reported in Table C which employed Test Oil 2 as the basic formation, modified by the addition of thiosalicylic acid at the indicated concentrations (basestock oil backed out to accommodate the additional thiosalicylic acid additive).

TABLE A

GENERALLY, SULHYDRYL GROUPS PROVIDE LOAD CAPACITY BUT ARE CORROSIVE TO COPPER; THIOSALICYLIC ACID PROVIDES LOAD CAPACITY BUT IS NOT CORROSIVE TO COPPER

| LOAD ADDITIVE | Cu CORROSION mg/sq cm | | SEVERE |
|---|---|---|---|
| | OCS* | ROLLS ROYCE* | FZG+ |
| 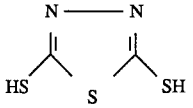 | −2.23 | — | 11 |

TABLE A-continued

GENERALLY, SULHYDRYL GROUPS PROVIDE LOAD CAPACITY BUT ARE CORROSIVE TO COPPER; THIOSALICYLIC ACID PROVIDES LOAD CAPACITY BUT IS NOT CORROSIVE TO COPPER

| LOAD ADDITIVE | Cu CORROSION mg/sq cm OCS* | Cu CORROSION mg/sq cm ROLLS ROYCE* | SEVERE FZG+ |
|---|---|---|---|
| 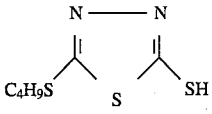 | — | −4.86 | 8 |
| 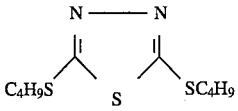 | — | −0.10 | 6 |
| 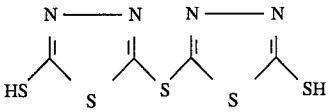 | — | −8.01 | 9 |
| 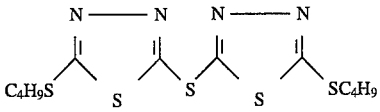 | — | −0.93 | 6 |
| 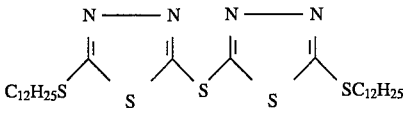 | — | −0.07 | 3 |
| 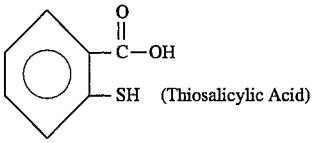 (Thiosalicylic Acid) | −0.09 | −0.09 | 7–9 |

*OCS and Rolls Royce 1002B (RR 1002B) specs on Cu, ≦0.4 mg/sq cm.
RR 1002B conditions, oil temperature 200° C. maintained for 8 days
+Target FZG, 8

TABLE B

LOW CORROSIVITY OF THIOSALICYLIC ACID ALSO EVIDENT ON RR 1002 A

| METAL/ALLOY | (mg/sq cm) Test Oil 2 0% TSA | (mg/sq cm) Test Oil 3 0.094% TSA | SPECS. |
|---|---|---|---|
| Al | 0.014 | 0.0 | 0.2 |
| Cu | −0.026 | 0.0 | 0.5 |
| Ti/Cu | 0.0 | 0.014 | 0.2 |
| Cu/Ni/Si | −0.014 | 0.0 | 0.2 |
| Mild Steel | 0.0 | 0.014 | 0.2 |
| Pb Bronze | −1.314 | −0.029 | 0.5 |
| High C/Cr Steel | 0.022 | 0.011 | 0.2 |
| Pb Brass | −1.257 | −0.486 | 0.5 |
| Ni/Cr Steel | 0.022 | 0.022 | 0.2 |
| High Speed Steel | −0.033 | 0.033 | 0.2 |

TABLE C

THIOSALCYLIC ACID HAS NO EFFECT IN SILICONE SEALS

| SILICONE SEAL COMPATIBILITY | RESULTS AT INDICATED WT % THIOSALCYLIC ACID IN TEST OIL 2 AS BASE FORMULATION (MODIFIED BY ADDITION OF TSA) 0.025 | 0.100 | SPECS |
|---|---|---|---|
| % Swell | 9.26 | 9.15 | 5–25 |
| (Δ %) Tensile Strength | −18.58 | −10.77 | 0–30 |

•TSA has no effect on non-silicone rubbers.

What is claimed is:

1. An aviation turbine oil of reduced copper corrosivity comprising a major amount of a base oil stock suitable for use as an aviation turbine oil comprising polyol esters and a minor amount of a mercapto benzoic acid or mixture of mercaptobenzoic acids.

2. The aviation turbine oil of claim 1 wherein the mercapto benzoic acid is present in an amount in the range 0.05 to 1.0 wt %.

3. The aviation turbine oil of claim 1 wherein the base oil stock has a kinematic viscosity ranging from about 5 to about 10,000 cSt at 40° C.

4. The aviation turbine oil of claim 1, 2 or 3 wherein the mercaptobenzoic acid is of the formula

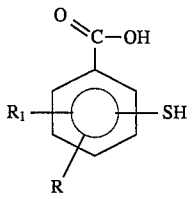

wherein the SH group is in the ortho position relative to the carboxyl group and R and $R_1$ may be the same or different and is selected from H, $C_1$ to $C_{10}$ hydrocarbyl group.

5. The aviation turbine oil of claim 4 wherein R and $R_1$ of the mercaptobenzoic acid are both hydrogen.

6. A method for lubricating an aviation turbo engine to withstand high loads, extreme pressure, and resist copper corrosion comprising operating the engine with a lubricating oil composition comprising a major amount of a base oil stock comprising polyol ester and a minor portion of a mercapto benzoic acid or mixture of mercapto benzoic acids.

7. The method of claim 6 wherein the mercapto benzoic acid is present in an amount in the range 0.05 to 1.0 wt %.

8. The method of claims 6 or 7 wherein the mercapto benzoic acid is of the formula:

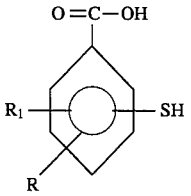

wherein the SH group is in the ortho position relative to the carboxyl group and R and $R_1$ may be the same or different and is selected from H, $C_1$ to $C_{10}$ hydrocarbyl group.

9. The method of claim 8 wherein R and $R_1$ are both hydrogen.

* * * * *